US012745851B2

(12) United States Patent
Naujoks

(10) Patent No.: US 12,745,851 B2
(45) Date of Patent: Sep. 29, 2026

(54) CONNECTOR FOR CONNECTING A COMPONENT TO A RECTANGULAR STRUCTURE

(71) Applicant: Wissner-Bosserhoff GmbH, Wickede (DE)

(72) Inventor: Tobias Naujoks, Menden (DE)

(73) Assignee: Wissner-Bosserhoff GmbH, Wickede (DE)

( * ) Notice: Subject to any disclaimer, the term of this patent is extended or adjusted under 35 U.S.C. 154(b) by 196 days.

(21) Appl. No.: 18/743,817

(22) Filed: Jun. 14, 2024

(65) Prior Publication Data

US 2024/0423377 A1 Dec. 26, 2024

(30) Foreign Application Priority Data

Jun. 20, 2023 (EP) ..... 23180452
Mar. 8, 2024 (EP) ..... 24162482

(51) Int. Cl.
*A47C 19/00* (2006.01)
*A47C 19/02* (2006.01)

(52) U.S. Cl.
CPC ..... *A47C 19/005* (2013.01); *A47C 19/022* (2013.01)

(58) Field of Classification Search
CPC ... A47C 19/005; A47C 19/022; A47C 19/021; A47C 19/025; A61G 13/101; A61G 13/121; A61G 13/125; F16B 2/185; F16B 2/12; F16B 2/56; F16B 2/06; F16B 2/245; B25B 1/02
USPC ..... 269/228; 248/229.12, 229.22, 228.3, 248/230.3, 231.41
See application file for complete search history.

(56) References Cited

U.S. PATENT DOCUMENTS 3,009,170 A * 11/1961 Akram ..... A47C 19/022 5/8
2007/0136947 A1 6/2007 Limpert
2012/0297538 A1* 11/2012 Rothschild ..... A47C 19/005 5/282.1

(Continued)

FOREIGN PATENT DOCUMENTS

EP 3473228 A1 * 4/2019 ..... A61G 7/0518
WO 2015/055817 A1 4/2015

OTHER PUBLICATIONS

European Search Report with English translation in European Application No. 23180452.7, dated Oct. 16, 2023, 9 pages.

*Primary Examiner* — Matthew Troutman
*Assistant Examiner* — Alison N Labarge
(74) *Attorney, Agent, or Firm* — Edell, Shapiro & Finnan, LLC

(57) ABSTRACT

A connector to connect a first part to a rectangular tube or rectangular beam includes first and second receiving elements that form a receptacle for the rectangular tube or rectangular beam. The first and second receiving elements are moveable relative to one another between a first position in which the rectangular tube or rectangular beam is clampable between the first and second receiving elements in the receptacle and a second position in which the rectangular tube or rectangular beam can be introduced into or released from the receptacle. The connector further includes a guide predefining a direction during movement of the first and second receiving elements from the first position into the second position and vice versa.

10 Claims, 11 Drawing Sheets

(56) References Cited

U.S. PATENT DOCUMENTS

| | | | | |
|---|---|---|---|---|
| 2013/0291300 | A1* | 11/2013 | Bly | F16B 2/185<br>24/593.1 |
| 2017/0143572 | A1* | 5/2017 | Bergman | A61G 13/101 |
| 2020/0018334 | A1* | 1/2020 | Le Mon | B25B 5/085 |
| 2022/0362084 | A1* | 11/2022 | Kovacs | A61F 5/3776 |

* cited by examiner

CONNECTOR FOR CONNECTING A COMPONENT TO A RECTANGULAR STRUCTURE

CROSS REFERENCE TO RELATED APPLICATIONS

This application claims priority under 35 U.S.C. § 119 (a)-(d) to European application No. 23180452.7 filed on Jun. 20, 2023, and European application No. 24162482.4 filed on Mar. 8, 2024, the entire contents of which are hereby incorporated by reference.

TECHNICAL FIELD

The present disclosure relates to a connector for connecting a first part to a rectangular tube or beam, in particular for connecting a side rail, a headboard or a footboard of a bed to a support of a bed. The disclosure furthermore relates to a bed, in particular a medical bed, in which a side rail, a headboard and/or a footboard of the bed are connected via at least one connector to a support of the bed.

BACKGROUND

Such a connector and such a bed are known from the document EP 3 473 228 B1. The connector has a panel comprising two hooks to engage in holes in a rectangular tube of a frame of a bed, namely an upper hook and a lower hook. The holes in the rectangular tube are provided in an upper wall and in a front side wall. The hooks are inserted into the holes. The upper hook has a trapezoidal section, which is inserted into the upper hole. This section is thus slightly smaller at the free end thereof than at the base thereof. When the section is inserted into the upper hole, the upper hook becomes wedged in the upper hole when the hook is moved into the hole. A trapezoidal notch, into which an edge of the lower hole is lowered when the lower hook is inserted into the lower hole, is provided between a section of the lower hook and the base thereof. The edge of the hole becomes wedged in the notch when the edge is moved into the notch.

The connector comprises a clamping lever including a lobe, by which the movement of the panel with the two hooks against the rectangular tube in the perpendicular transverse direction thereof can be effectuated. The clamping lever can be moved between a first position, in which the connector can be released from the rectangle or attached to the rectangular tube, and a second position, in which the connector is fixedly connected to the rectangular tube. A spring-loaded locking bar is attached to the clamping lever. In the second position, the locking bar prevents the clamping lever from being inadvertently brought into the first position. It has to be pulled back for the clamping lever to be released.

Introducing the holes into which the hooks are inserted into the rectangular tube is a complex process. Another disadvantage is the trapezoidal shape of the upper hook and of the notch at the lower hook. It is true that, as long as the connector is fastened to the rectangular tube, it is ensured in this way that a fixed connection to the rectangular tube also exists in the horizontal transverse direction. However, when the connection is to be released, the wedge action can be so strong that the panel with the hooks can only be released from the rectangular tube with great force expenditure.

The document EP 3 473 228 B1, however, also states that the connector could be configured such that, in addition or as an alternative, a hook-shaped engagement section can be provided, which could surround a frame of the bed. A specific embodiment of such a connector, however, is not described.

The document US 2007/136947 A1 discloses a connector comprising a clamping lever, which acts on a bolt. One end of the bolt has a bearing surface. Even though the connector from the document US 2007/136947 A1 has a receptacle, it does not have two receiving elements that, together, form this receptacle. The connector from the document US 2007/136947 A1 comprises only one receiving element, which is referred to in the document US 2007/136947 A1 at paragraph as a "rail-receiving channel block." As disclosed in paragraph of US 2007/136947, this receiving element forms a receptacle ("rail-receiving channel") for the beam. The bolt 30 forms a clamping element, by way of which the beam 14 is held by clamping in the receptacle RC of the receiving element 40*a*. The beam 14 is clamped between the end 32 of the bolt 30 and the section 44*d* of the receiving element 40*a*.

The document JP H 03182208 A describes a connector which has two hooks that can be moved relative to one another, which extend over and under a rectangular tube. Ends of the hooks engage behind the rectangular tube. These hooks can be pulled against one another, whereby these are clamped to the rectangular tube. For this purpose, a spring pulls the upper hook against the lower hook. There is no clamping in the horizontal transverse direction of the rectangular tube. As a result, a movement of the connector in the transverse direction of the rectangular tube may occur. The connection between the connector and the rectangular tube can be released easily and without major force expenditure.

SUMMARY

It is an object of the disclosed device, proceeding from the connector known from the document JP H 03182208 A, to connect a first part to a rectangular tube or beam, which effectuates clamping both in the horizontal direction and in the perpendicular transverse direction and which can be released from the rectangular tube or beam easily and without any special force expenditure.

This object is achieved according to the disclosed device in that the connector comprises a guide predefining the direction during the movement of the first receiving element and of the second receiving element from the first position into the second position, and vice versa.

Via the guide, it is predefined how the receiving elements are moved with respect to one another for clamping the tube or the beam, and in which directions clamping forces act. At the same time, the guide predefines how the receiving elements have to be moved when the clamping is being released. A wedge action is not being used. A fixation of two receiving elements or hooks or hook-shaped engagement elements, such as are used in the connector from document EP 3 473 228 B1, achieved by a wedge action does not have to be released.

The first receiving element and the second receiving element can each have a first bearing surface. The first bearing surface of the first receiving element and the first bearing surface of the second receiving element form two sides of the receptacle located opposite one another. These first bearing surfaces are provided to bear against the tube or beam, for example an upper side, on mutually opposing sides when a connection exists between the connector and the tube or beam. In the first position, the first bearing surfaces can be spaced a smaller distance apart from one another than in the second position. During a change from the second position into the first position, the first bearing surfaces are moved toward one another. In the process, the first bearing surfaces bear against the mutually opposing sides of the tube or of the beam and are pushed by way of a clamping force against the sides.

The first receiving element and the second receiving element can each have a second bearing surface and/or a third bearing surface. In the first position, the second bearing surfaces and third bearing surfaces are preferably perpendicular or substantially perpendicular to the first bearing surfaces. The second bearing surfaces are provided to bear against the tube or beam on mutually opposing sides when a connection exists between the connector and the tube or beam. The same applies to the third bearing surfaces. These are also provided to bear against the tube or beam on mutually opposing sides when a connection exists between the connector and the tube or beam. These are preferably perpendicular or substantially perpendicular to the sides of the tube against which the first bearing surfaces bear. Preferably, a second and a third bearing surface are provided to bear against one side, for example the left side, and the other second and third bearing surfaces are provided to bear against an opposing side of the tube or of the beam, for example the right side.

The second bearing surface of the first receiving element and the second bearing surface of the second receiving element can then form two mutually opposing sections of sides of the receptacle, for example the first receiving element can form the second bearing surface on the left side and the second receiving element on the right side of the receptacle. In the first position, the second bearing surfaces are preferably spaced a smaller distance apart from one another than in the second position. During a change from the second position into the first position, the second bearing surfaces are moved toward one another. In the process, the second bearing surfaces bear against the mutually opposing sides of the tube or of the beam and are pushed by way of a clamping force against the sides.

The third bearing surface of the first receiving element and the third bearing surface of the second receiving element can form two mutually opposing sections of sides of the receptacle, for example the first receiving element can form the second bearing surface on the left side and the second receiving element can do so on the right side of the receptacle. In the first position, the third bearing surfaces can also be spaced a smaller distance apart from one another than in the second position. During a change from the second position into the first position, the third bearing surfaces are also moved toward one another. In the process, the third bearing surfaces also bear against the mutually opposing sides of the tube or of the beam and are pushed by way of a clamping force against the sides.

The guide of the connector, which is provided to guide the receiving elements during the change from the first position into the second position or vice versa, can comprise at least one, but preferably two slotted guide systems. For example, the first receiving element can have a first slot, and a sliding block that is fastened to the second receiving element can be arranged in this first slot, wherein the first slot is oriented such that, during a movement into the first position, in particular the first bearing surfaces are moved toward one another, and the second bearing surfaces are moved toward one another. Furthermore, the first receiving element can have a second slot, and a second sliding block that is fastened to the second receiving element can be arranged in this second slot, wherein the second slot is oriented in such a way that, during a movement into the first position, the first bearing surfaces are moved toward one another, and the third bearing surfaces are moved toward one another.

The slots of the two slotted guide systems can be inclined with respect to the second and third bearing surfaces, at least in sections, and can extend obliquely thereto. The two slots can be inclined with respect to the second and third bearing surfaces in opposite directions. The slots can have a straight or a curved profile.

The connector can comprise a clamping lever, by way of which the movement from the second position into the first position can be effectuated when the lever is actuated. The clamping lever can comprise a lobe via which, upon actuation, a force is exerted on the first or the second receiving element, by which the first receiving element and the second receiving element are pressed against the rectangular tube or the rectangular beam when the lever is actuated for moving the receiving elements from the second into the first position.

The clamping connection between the connector and the rectangular tube or beam can be easily established and released again by almost anyone using the clamping lever, without tools.

In particular, the easy releasability without any tool may be undesirable. Instead, a fixed connection may be desirable, which can only be released using tools.

As an alternative to a clamping lever, a different clamping element can be provided, by way of which the movement from the second position into the first position can be effectuated when the element is actuated. This alternative clamping element can comprise a drive, in particular a screw head drive, to which a tool, in particular a screwdriver, a wrench or the like, can be applied for actuating the clamping element. The clamping element can be a screw. The screw can be guided through a threaded hole in the first receiving element, and the tip of the screw shank can bear against the second receiving element. By rotating the screw, the first receiving element and the second receiving element can be moved relative to one another and from the second position into the first position. By loosening the screw, it is possible to transfer the first receiving element and the second receiving element from the first position into the second position. Instead of a screw connection between the clamping element and the first receiving element, a bayonet catch can be provided, by which a, for example bolt-shaped, clamping element can be moved relative to the first receiving element between two positions.

The connector can comprise connecting structures for the connection to the first part. The connector can be connected to the first part fixedly and non-releasably, only releasably by way of tools, or in another manner.

BRIEF DESCRIPTION OF THE DRAWINGS

Additional features and advantages of exemplary embodiments of the disclosed device will be described hereafter with reference to the drawings. The same reference numerals are used for identical or like parts and for parts having identical or like functions.

DETAILED DESCRIPTION

It is not necessary for a device according to the disclosure to have all the features described hereafter. It is also possible for a device according to the disclosure to have only individual features of the variants described hereafter. Hereafter, the features are described which the first variant and the second variant have. If only one variant has certain features, this is described.

The variants of the connector according to the disclosure can be used to fasten a first part to a rectangular tube R or a beam.

Figure 1:
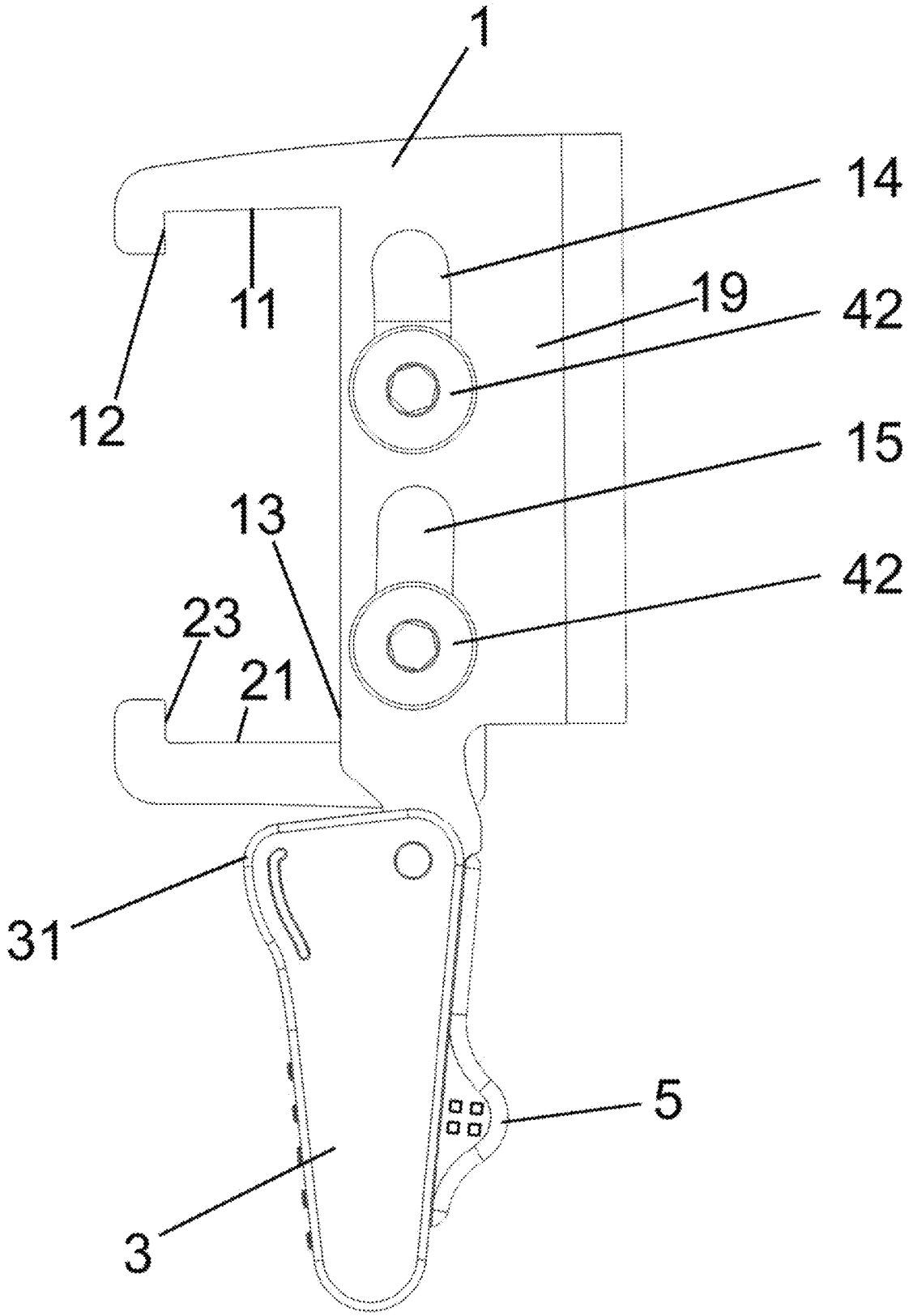
FIG. 1 shows a view from the front of a first variant of a connector in a first position of a first receiving element and of a second receiving element with respect to one another.
Figure 1A:
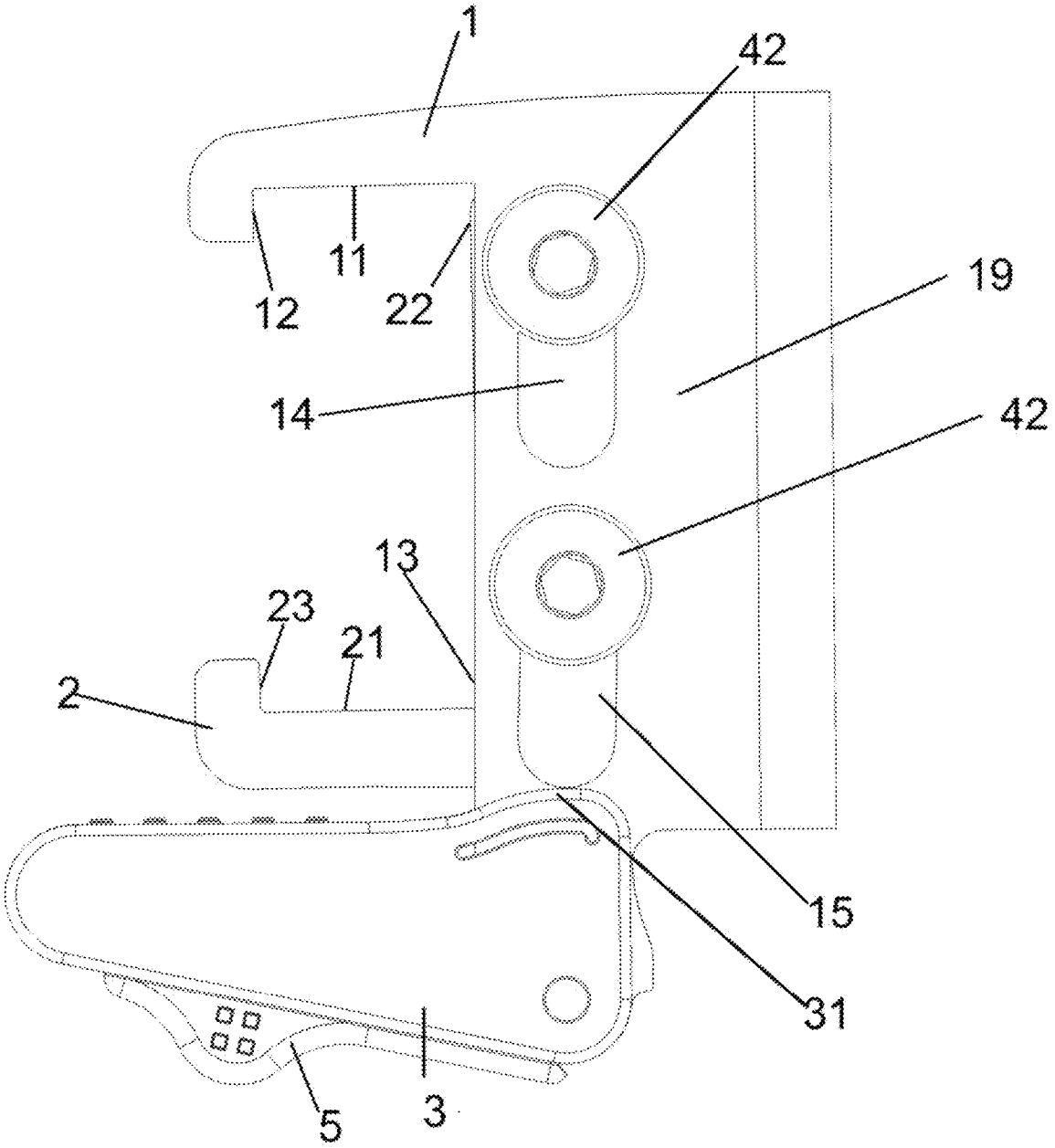
FIG. 1*a* shows a view from the front of the first variant of the connector in a second position of the first receiving element and of the second receiving element with respect to one another.
Figure 2:
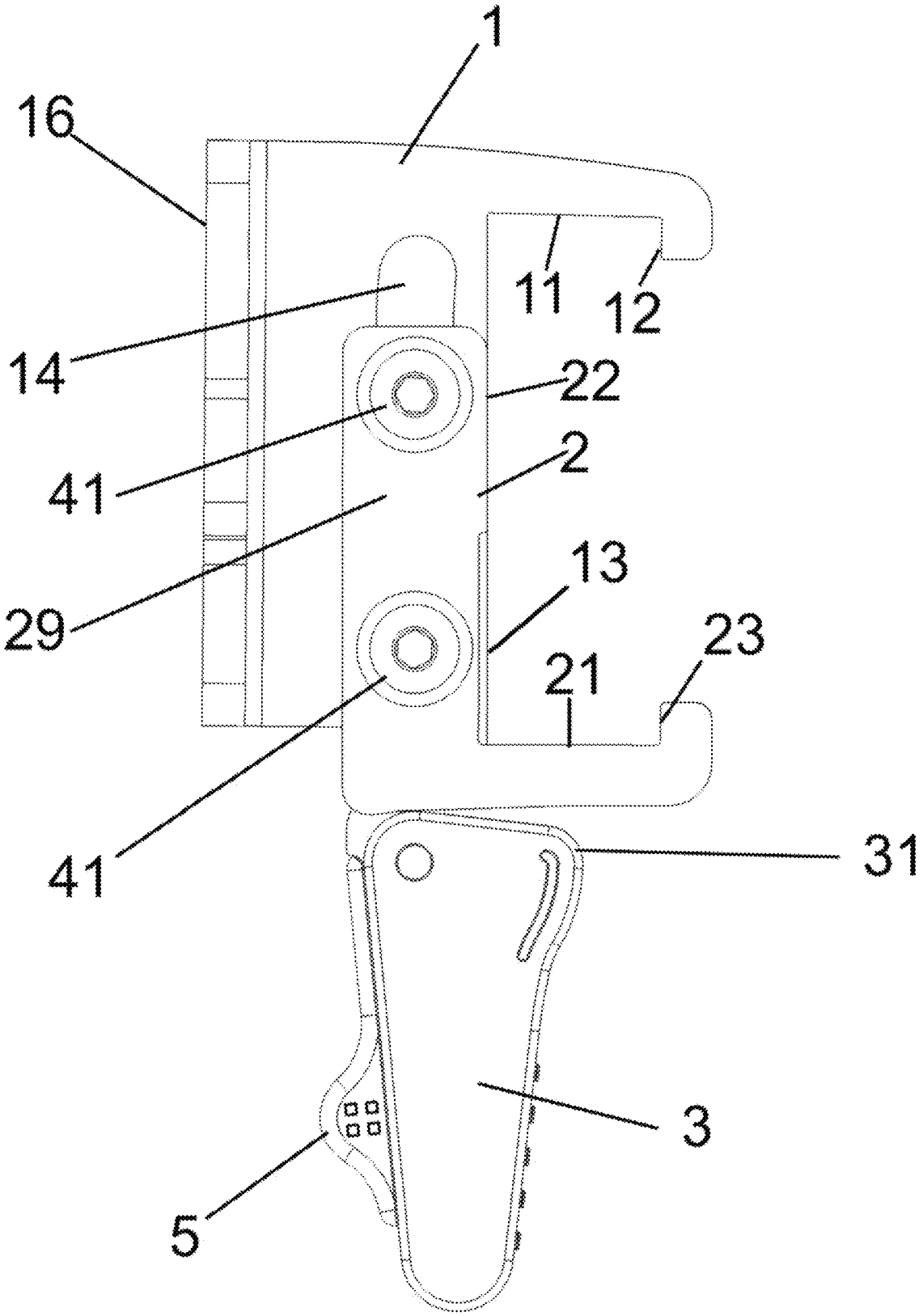
FIG. 2 shows a view from the rear of the first variant of the connector in the first position of the first receiving element and of the second receiving element with respect to one another.
Figure 2A:
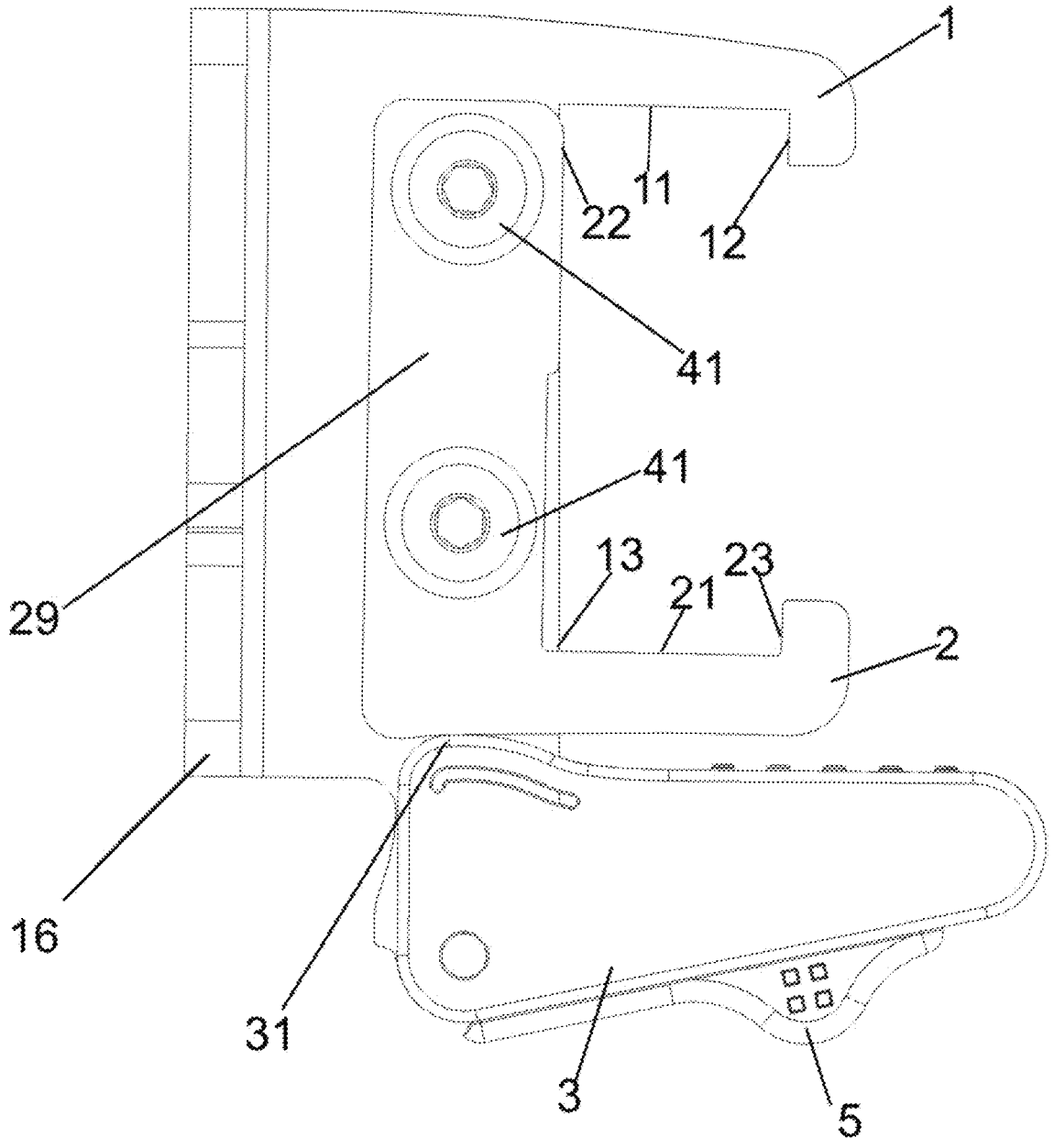
FIG. 2*a* shows a view from the rear of the first variant of the connector in the second position of the first receiving element and of the second receiving element with respect to one another.
Figure 3:
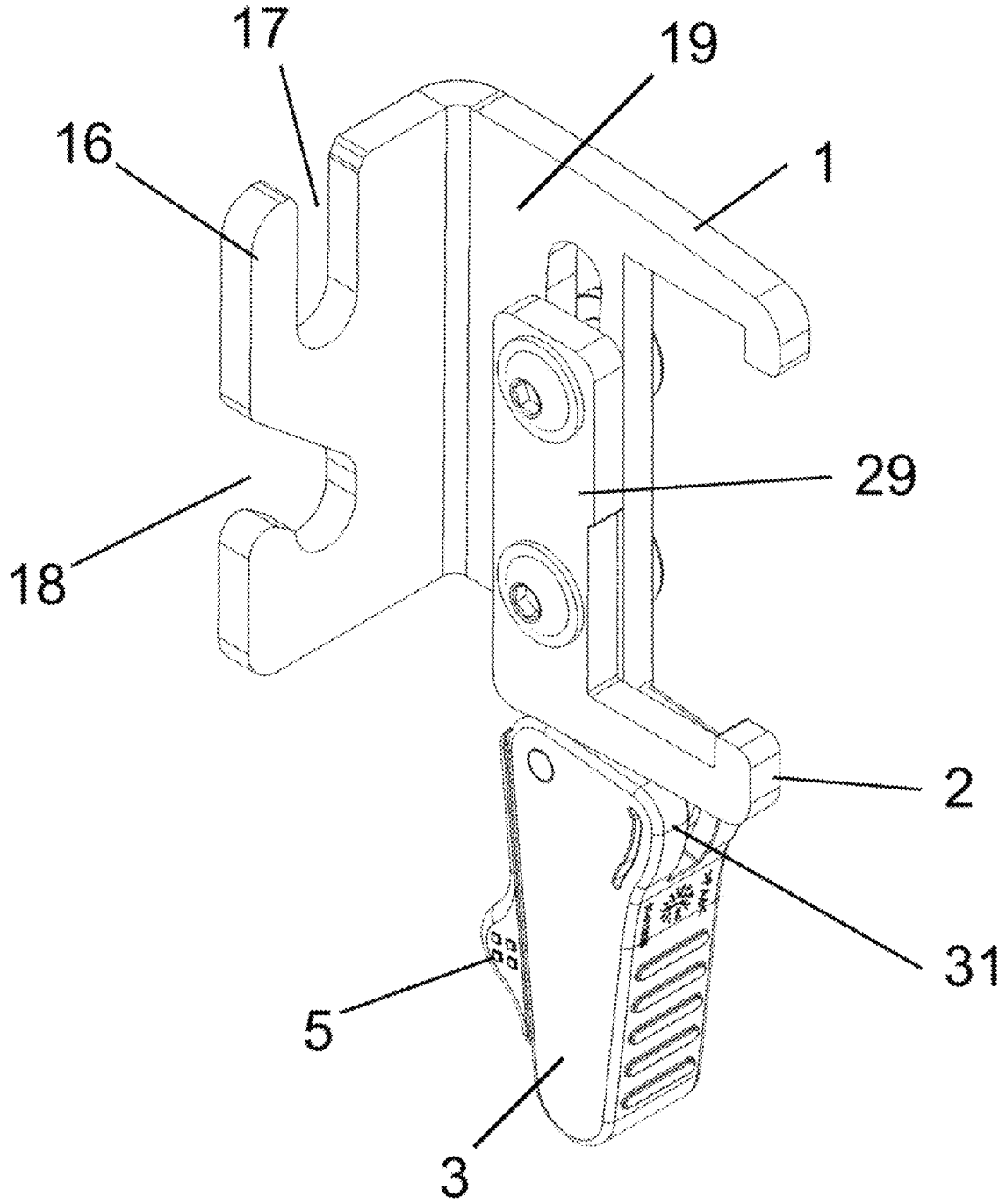
FIG. 3 shows a perspective view of the first variant of the connector in the first position of the first receiving element and of the second receiving element with respect to one another.
Figure 3A:
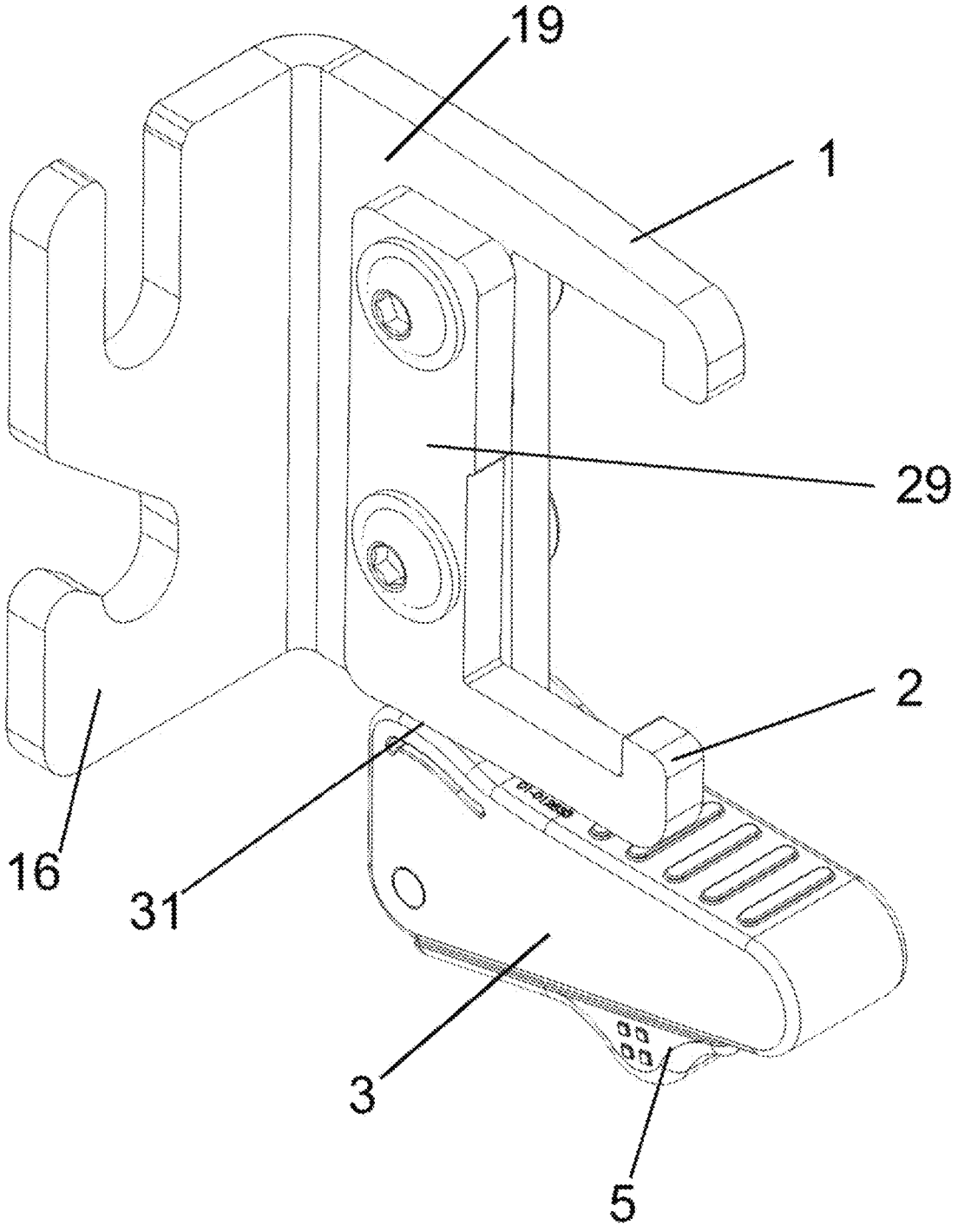
FIG. 3*a* shows a perspective view of the first variant of the connector in the second position of the first receiving element and of the second receiving element with respect to one another.

Referring to FIGS. 1, la, 2, 2*a*, 3, 3*a*, and 4-8, in addition to a first receiving element 1, a second receiving element 2 and, in the first variant, a clamping lever 3, or, in the second variant, a screw 3*a* instead of the clamping lever, the variants of the connector according to the disclosure comprise two screws 41 and two sleeve nuts 42*a*.

The first receiving element 1 and the second receiving element 2 are made of sheet metal. For this purpose, the receiving elements 1, 2 are cut from the sheet metal with an outer contour and provided with elongated holes. Each of the two receiving elements 1, 2 has a substantially rectangular base 19, 29 (FIG. 1).

So as to produce the first receiving element 1, the cut-out sheet metal piece provided with the elongated holes is bent so as to have a projecting leg 16, which is connected to the base 19.

The leg 16 has slits 17, 18, which serve the connection between the connector and the first part. The connection can be arbitrary for the disclosed device and is therefore not described in greater detail here.

Figure 4:
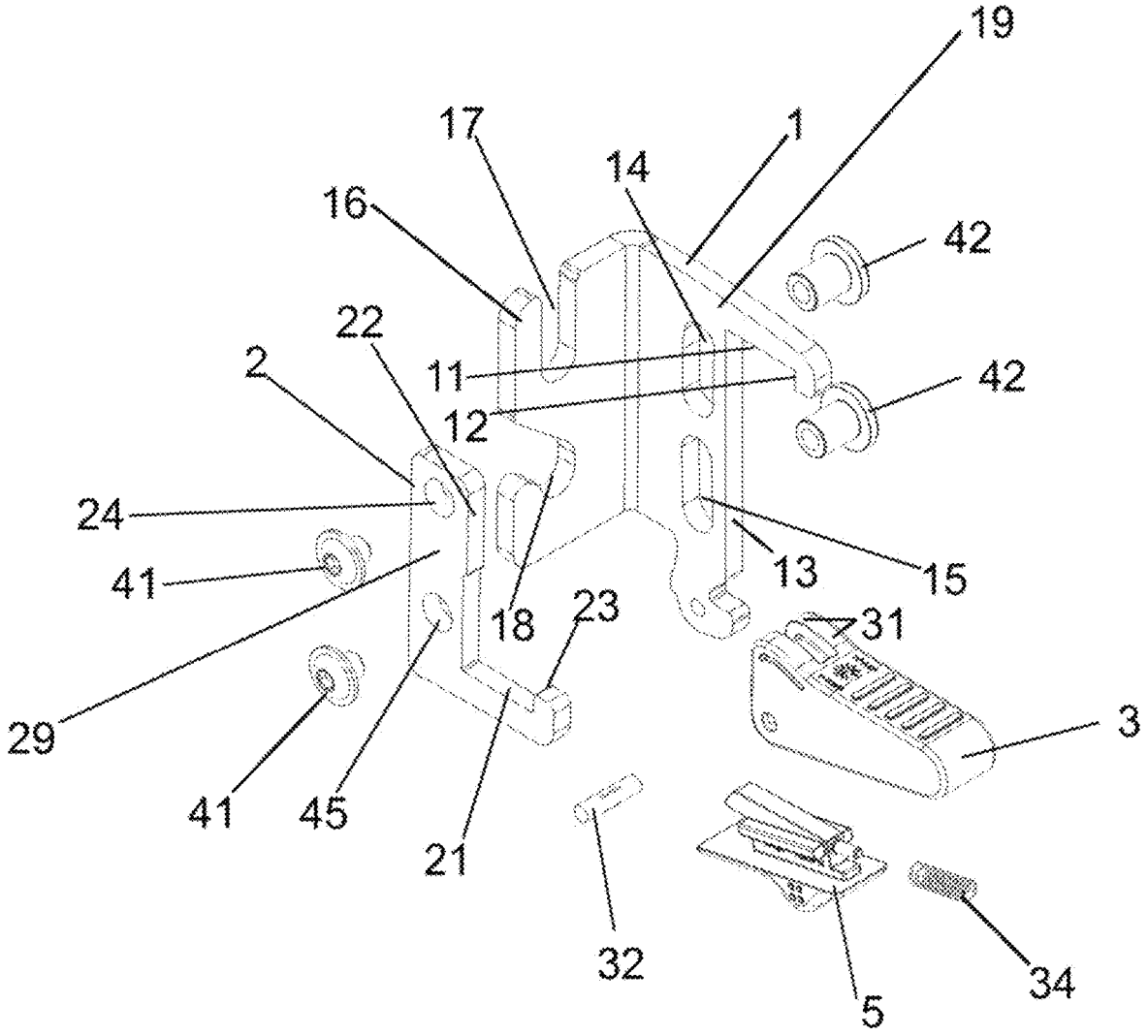
FIG. 4 shows an exploded view of the first variant of the connector.
Figure 5:
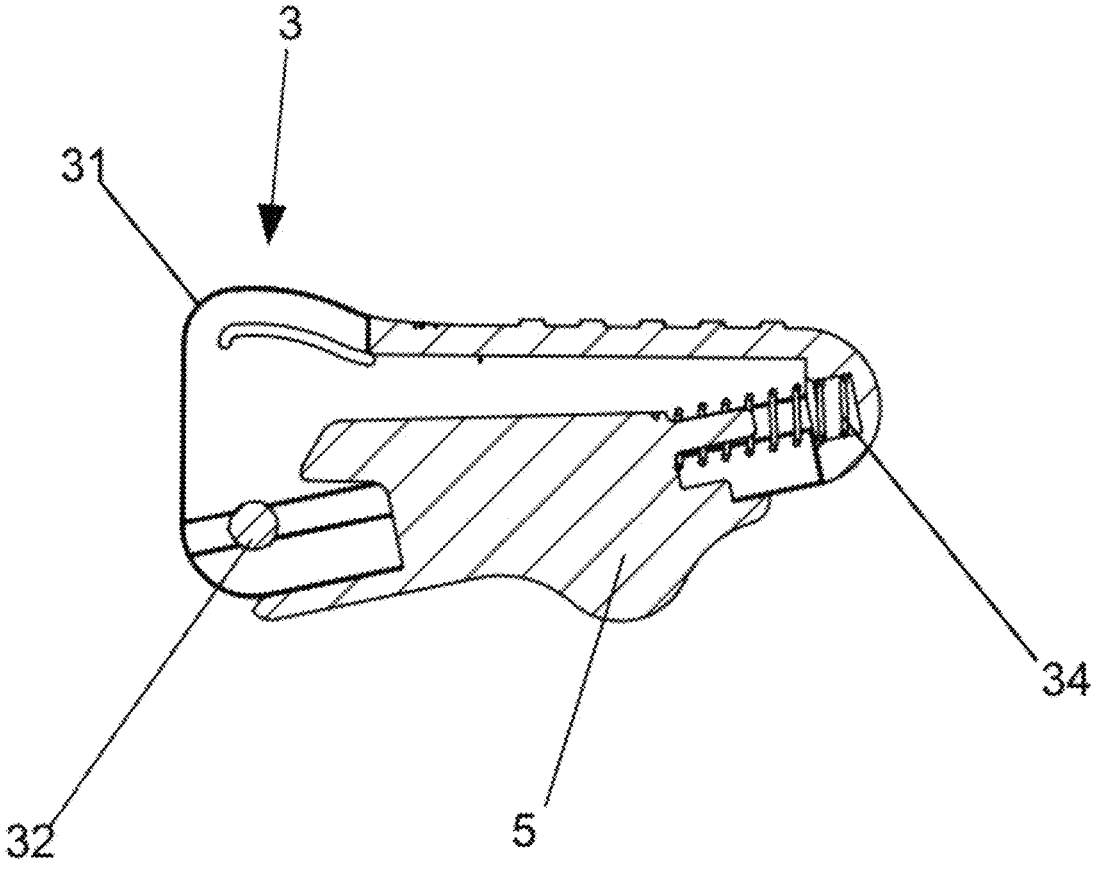
FIG. 5 shows a sectional illustration of a clamping lever of the first variant.
Figure 6:
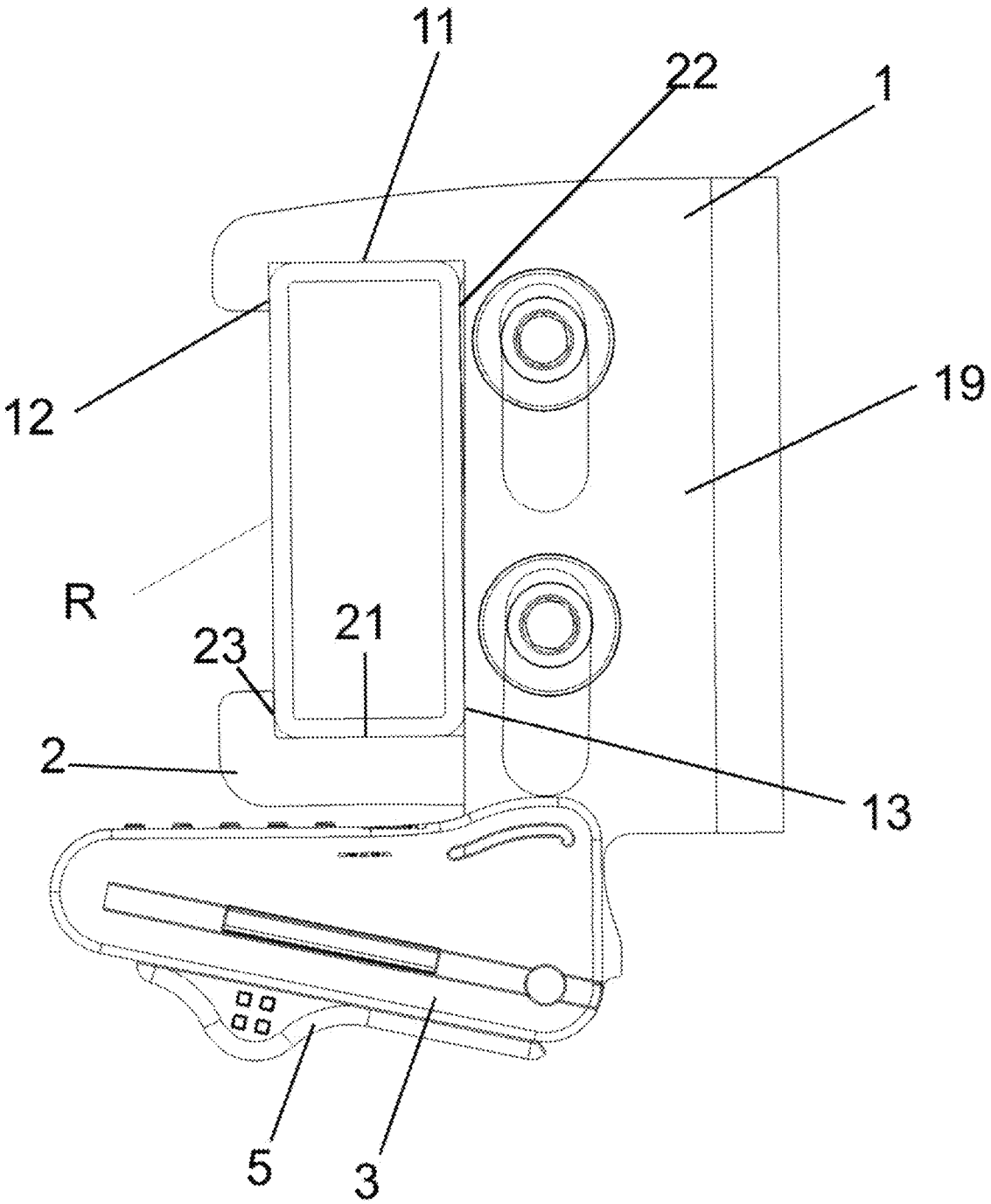
FIG. 6 shows a view of the first variant of the connector from the front and a rectangular tube, which are connected to one another.
Figure 7:
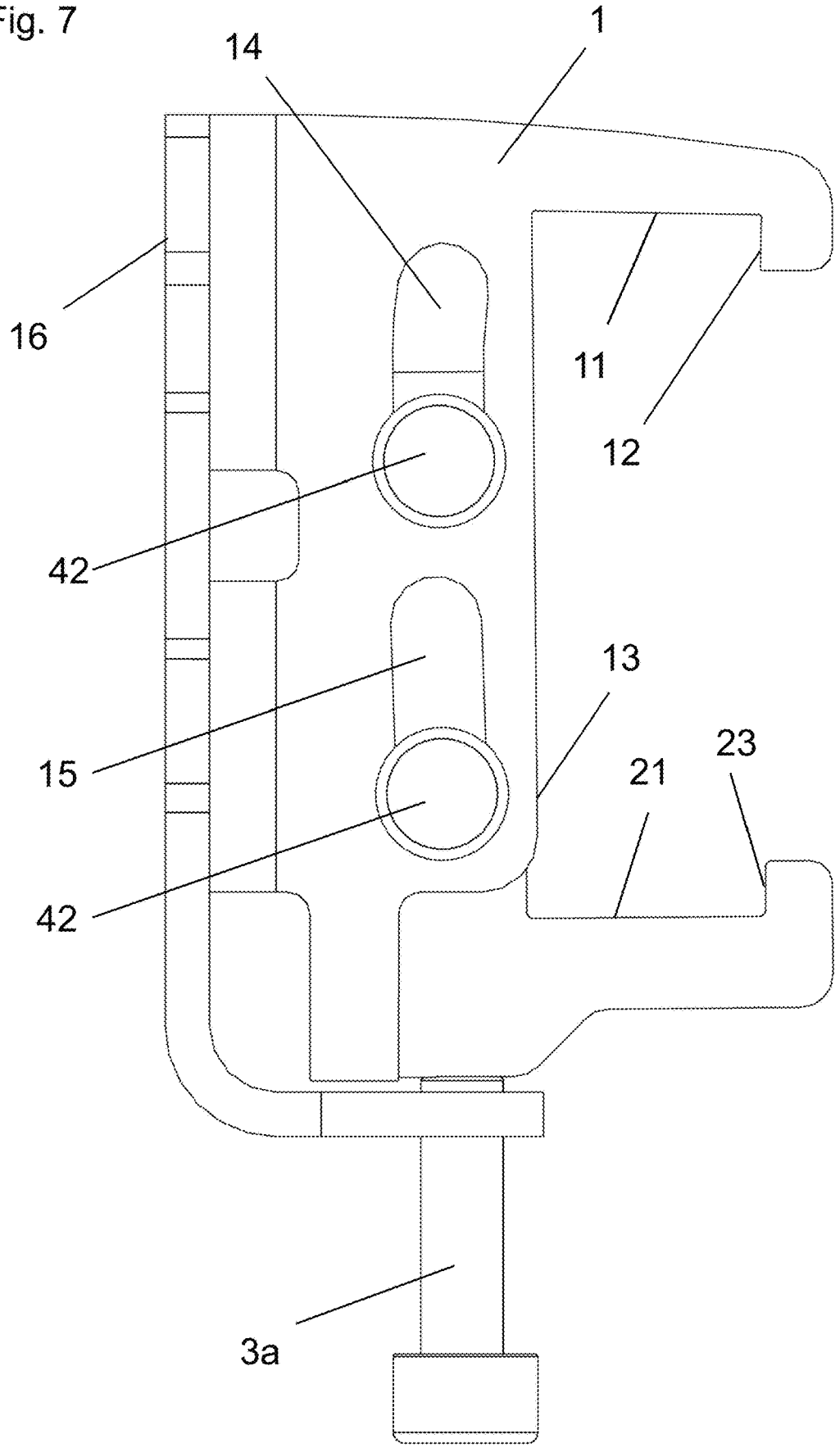
FIG. 7 shows a view from the rear of a second variant of the connector in the second position of the first receiving element and of the second receiving element with respect to one another.
Figure 8:
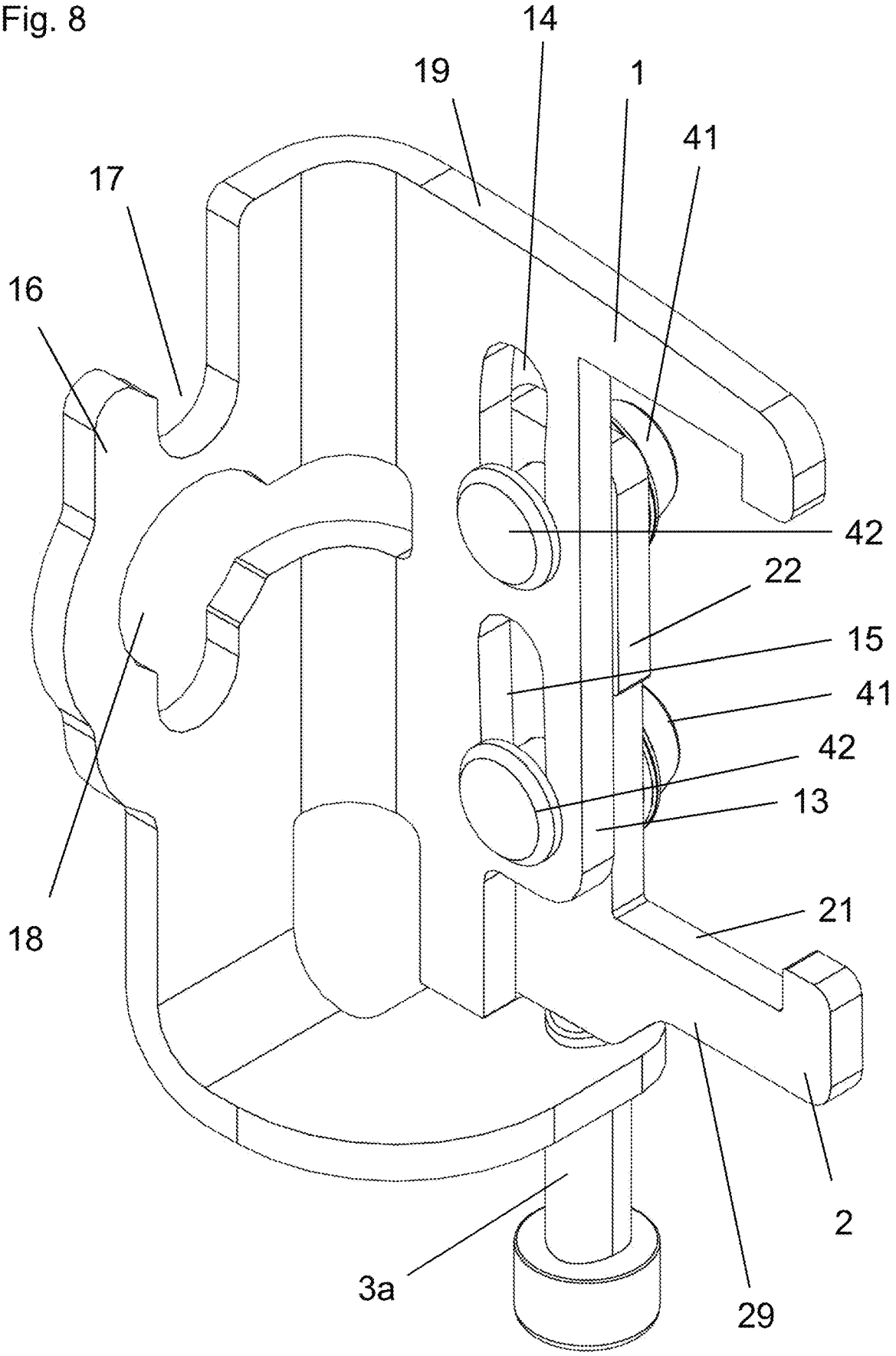
FIG. 8 shows a perspective view of the second variant of the connector in the second position of the first receiving element and of the second receiving element with respect to one another.

The first receiving element 1, at the upper end thereof, comprises an arm projecting from the base 19 to the left, the free end of which is elbowed. An inner side of the arm forms a first bearing surface 11 (FIG. 4), and an inner side of the elbow forms a second bearing surface 12. In the first position of the receiving elements 1, 2, the first bearing surface 11 bears against the upper side of the rectangular tube R. In the first position, the second bearing surface 12, which is perpendicular to the first, bears against the upper, left side of the rectangular tube R. A lower end of the side of the base 19 located opposite the second bearing surface 12 forms a third bearing surface 13 of the first receiving element 1, which in the first position of the receiving elements 1, 2 bears on the lower, right side against the rectangular tube R.

The second receiving element 2, at the lower end thereof, comprises an arm projecting from the base 29 to the left, the free end of which is likewise elbowed. An inner side of the arm forms a first bearing surface 21, and an inner side of the elbow forms a third bearing surface 23. In the first position of the receiving elements 1, 2, the first bearing surface 21 bears against the lower side of the rectangular tube R. In the first position, the third bearing surface 23, which is perpendicular to the first, bears against the lower, left side of the rectangular tube R. An upper end of the side of the base 29 located opposite the third bearing surface 23 forms a second bearing surface 22 of the second receiving element 2, which in the first position of the receiving elements 1, 2 bears against the upper, right side against the rectangular tube R.

As a result, in the first position of the receiving elements 1, 2, the first bearing surfaces 11, 21, the second bearing surfaces 12, 22 and the third bearing surfaces 13, 23 bear against opposing sides of the rectangular tube R. The two receiving elements 1, 2 form a receptacle in which the rectangular tube is received.

In the second position of the receiving elements 1, 2, the mutually opposing first bearing surfaces 11, 21, the mutually opposing second bearing surfaces 12, 22 and the mutually opposing third bearing surfaces 13, 23 are spaced further apart from one another than in the first position. During a change from the first position into the second position, the receiving elements 1, 2 are moved apart. The bearing surfaces 11, 21, 12, 22, 13, 23 are moved so far apart in the process that the rectangular tube can be taken out of the receptacle, or the connector can be removed from the rectangular tube R. In relation to the first receiving element, the second receiving element 2 is displaced downwardly and, at the same time, is displaced with the lower end, based on the view of the connector, to the left and with the upper end is displaced to the right. During the change from the first position into the second position, the second receiving element does not perform a linear movement, but is linearly moved while being pivoted.

The movement direction from the first into the second position, and also from the second into the first position, is predefined by a guidance by two slotted guide systems. Each of the slotted guide systems comprises a slot 14, 15 and sliding blocks 41, 42. Elongated holes are provided as slots in the base 19 of the first receiving element 1, and the screws 41 and sleeve screws 42 serve as sliding blocks, which, on the one hand, are guided through round holes in the base 29 of the second receiving element 2 and, on the other hand, are guided in the slots 14, 15. The screws 41 are screwed into the sleeve nuts 42. In the first position, the sliding blocks 41, 42 are situated at the upper ends of the slots 14, 15.

The slot 14, which is the upper slot in the illustrations of the figures, is slightly curved so that the sliding part 41, 42 guided in this slot 14 is moved along a curve during the change from the first position into the second position. The upper end of the second receiving element 2 is thus moved to the right.

The lower slot 15 is substantially linear and extends from the top to the bottom, wherein it is slightly inclined to the right. During a movement from the first position into the second position, the lower end of the second receiving element 2 is thus moved to the left and down in relation to the first receiving element 1. As a result, the second receiving element 2 can clear the rectangular tube, and the connector can be removed from the rectangular tube.

In the first variant of the connector, the movement from the first position into the second position is effectuated by an actuation of a clamping lever 3, which is pivotably mounted at the first receiving element 1 with a cotter pin 32. The cotter pin 32 is inserted for this purpose through a hole in the pivoting lever 3 and a hole in the first receiving element 1. The clamping lever is furcated in the region of the pivot joint thus formed and surrounds the first receiving element 1.

The clamping lever 3 comprises a lobe 31. In the first position, this lobe bears against a lower side of the second receiving element 2, pushing the same against the rectangular tube in the second position, so that this tube is clamped between the first bearing surfaces 11, 21, the second bearing surfaces 12, 22, and the third bearing surfaces 13, 23. The clamping lever 3 is then in an approximately horizontal position.

So as to release the connection between the connector and the rectangular tube, the clamping lever 3 is pivoted into an approximately vertical position. In the process, the lower side of the second receiving element 2 can clear the lobe 31, and the bearing surfaces 21, 22, 23 of the second receiving element 2 move away from the rectangular tube R in the manner predefined by the slotted guide systems.

So as to prevent the clamping lever 3 from being inadvertently actuated, a linearly displaceable locking bar 5 is provided at the clamping lever 3. In the clamping position, one end of this locking bar 5 is pushed by a spring 34 into a notch of the first receiving element 1, whereby pivoting of the clamping lever 3 is prevented. When the locking bar 5 is pulled back against the pressure of the spring 34, the clamping lever 3 can be pivoted.

In the second variant of the connector according to the disclosure, a screw 3*a* is provided, instead of the clamping lever, as the clamping element, by way of which the receiving elements 1, 2 can be moved relative to one another so as to be brought from the first position into the second position, and vice versa. The screw 3*a* can have a hexagon socket, serving as the screw head drive. A tool can be applied to this drive so as to turn the screw, and thereby actuate the clamping element designed as a screw of the second variant of the connector. The screw is screwed into a threaded hole, which is provided in a tab 16*a* of the first receiving element 1 projecting from the leg 16. This tab 16*a* is approximately situated at a right angle with respect to the leg 16 and the base 19 of the first receiving element 1.

One end of a screw shank of the screw 3*a* bears against a lateral surface of the base 29 of the second receiving element 2. When the screw 3*a* is screwed into the hole, the end of the screw 3*a* pushes on the second receiving element, thereby moving the first and second receiving elements relative to one another from the first position into the second position. By loosening the screws, it is possible to move the first receiving element and the second receiving element relative to one another from the second position into the first position.

What is claimed is:

1. A connector to connect a first part to a rectangular tube or rectangular beam, the connector comprising:

first and second receiving elements that form a receptacle for the rectangular tube or rectangular beam, the first and second receiving elements being moveable relative to one another between a first position in which the rectangular tube or rectangular beam is clampable between the first and second receiving elements in the receptacle and a second position in which the rectangular tube or rectangular beam can be introduced into or released from the receptacle, wherein:

each of the first and second receiving elements has a first bearing surface, the first bearing surface of the first receiving element and the first bearing surface of the second receiving element forming two mutually opposing sides of the receptacle;

the first receiving element has a second bearing surface that, in the first position, is perpendicular or substantially perpendicular to the first bearing surface of the first receiving element, and the second receiving element has a second bearing surface that, in the first position, is perpendicular or substantially perpendicular to the first bearing surface of the second receiving element; and the first receiving element has a third bearing surface that, in the first position, is perpendicular or substantially perpendicular to the first bearing surface of the first receiving element, and the second receiving element has a third bearing surface that, in the first position, is perpendicular or substantially perpendicular to the first bearing surface of the second receiving element; and a guide comprising at least one guide system and predefining a direction during movement of the first and second receiving elements from the first position into the second position and vice versa, wherein the at least one guide system comprises:

a first slotted guide system comprising a first slot on the first receiving element and a first sliding block fastened to the second receiving element and arranged in the first slot, the first slot being oriented such that, during a movement into the first position, at least the first bearing surfaces of the first and second receiving elements are moved toward one another, and the second bearing surfaces of the first and second receiving elements are moved toward one another; and a second slotted guide system comprising a second slot on the first receiving element and a second sliding block fastened to the second receiving element and arranged in the second slot, the second slot being oriented such that, during a movement into the first position, at least the first bearing surfaces of the first and second receiving elements are moved toward one another, and the third bearing surfaces of the first and second receiving elements are moved toward one another, wherein the first and second slots are inclined in opposite directions with respect to the second and third bearing surfaces of the first receiving element.

2. The connector of claim 1, wherein, in the first position, the first bearing surfaces of the first and second receiving elements are spaced a smaller distance apart from one another than in the second position.

3. The connector of claim 1, wherein the second bearing surface of the first receiving element and the second bearing surface of the second receiving element form two mutually opposing sections of sides of the receptacle.

4. The connector of claim 3, wherein, in the first position, the second bearing surfaces of the first and second receiving elements are spaced a smaller distance apart from one another than in the second position.

5. The connector of claim 1, wherein the third bearing surface of the first receiving element and the third bearing surface of the second receiving element form two mutually opposing sections of sides of the receptacle.

6. The connector of claim 5, wherein, in the first position, the third bearing surfaces of the first and second receiving elements are spaced a smaller distance apart from one another than in the second position.

7. The connector of claim 1, wherein the first and second slots extend obliquely to the second and third bearing surfaces of the first receiving element.

8. The connector of claim 1, further comprising a clamping element, wherein the first and second receiving elements are brought from the first position into the second position in response to actuation of the clamping element.

9. The connector of claim 1, wherein the rectangular tube or rectangular beam constitutes as least part of a side rail, a headboard, or a footboard of a bed.

10. A bed, comprising:

a rectangular tube or rectangular beam;

at least one side rail;

a headboard; and a footboard, wherein the at least one side rail, the headboard, and/or the footboard are releasably fastened to the rectangular tube or rectangular beam by at least one connector according to claim 1.

* * * * *